United States Patent [19]

Rasmussen

[11] Patent Number: 4,969,851

[45] Date of Patent: Nov. 13, 1990

[54] TOY VEHICLE WITH CHANGING STYLE FEATURE

[75] Inventor: Russell G. Rasmussen, Culver City, Calif.

[73] Assignee: Marvin Glass & Associates Liquidating Trust, Chicago, Ill.

[21] Appl. No.: 470,988

[22] Filed: Jan. 26, 1990

[51] Int. Cl.[5] ..... A63H 18/00; A63H 17/40; A63H 17/26; A63H 17/00

[52] U.S. Cl. ..... 446/444; 446/441; 446/470; 446/94

[58] Field of Search ..... 446/444, 441, 442, 443, 446/431, 337, 321, 464, 465, 466, 469, 470, 471, 486, 487, 93, 94, 95, 4, 428, 427

[56] References Cited

U.S. PATENT DOCUMENTS

| | | | |
|---|---|---|---|
| 1,321,109 | 11/1919 | Lasares | 446/95 |
| 1,586,608 | 1/1926 | Carver | 446/431 |
| 3,445,959 | 5/1969 | Barlow et al. | 446/442 |
| 3,748,780 | 7/1973 | Glass et al. | 446/464 |
| 3,814,021 | 6/1974 | McHenry | 446/444 X |
| 4,385,466 | 5/1983 | ReVelle | 446/470 X |
| 4,490,124 | 12/1984 | Ogawa | 446/464 |
| 4,493,671 | 1/1985 | Kennedy et al. | 446/464 |
| 4,516,952 | 5/1985 | Brand et al. | 446/427 |
| 4,605,381 | 8/1986 | MacBain et al. | 446/321 |
| 4,717,367 | 1/1988 | Stubenfoll et al. | 446/441 X |

FOREIGN PATENT DOCUMENTS

| | | | |
|---|---|---|---|
| 0253045 | 1/1988 | European Pat. Off. | 446/470 |
| 2214099 | 8/1989 | United Kingdom | 446/443 |

*Primary Examiner*—Robert A. Hafer
*Assistant Examiner*—D. Neal Muir
*Attorney, Agent, or Firm*—John S. Pacocha

[57] ABSTRACT

A toy vehicle with opposed faces on the chassis has a pivotally movable piece carried by the chassis with the piece being biased by a bowed overcenter spring away from a playing surface on which the toy vehicle is supported on its wheels. The portion of the movable biased piece oriented away from the playing surface projects beyond the upper periphery of the wheels. When the toy vehicle flip over, impact upon the projecting portion of the movable biased piece overcomes the bias and pivots the piece so that an opposed portion projects out the other face of the chassis to present a differently styled vehicle. Trackway segments are also provided to effect and end over end flip over of the vehicle and a side or rollover flip of the vehicle.

20 Claims, 2 Drawing Sheets

TOY VEHICLE WITH CHANGING STYLE FEATURE

BACKGROUND OF THE INVENTION

1. Field of the Invention

This invention relates generally to toy vehicles and more particularly to toy vehicles having a force responsive feature.

2. Background Art

Toy vehicles have long been popular playthings and numerous toy vehicles have included a force responsive feature. Klimpert et al. U.S. Pat. No. 4,508,521 issued Apr. 2, 1985 shows an impact responsive toy vehicle with a biased body part that revolves upon impact to switch an undamaged portion with a previously hidden damaged portion. Some prior art force responsive toy vehicles flip over in response to impact. Thus, Barlow et al. U.S. Pat. No. 3,445,959 issued May 27, 1969 discloses a toy car with a "drag racer" type body having large driven rear wheels and a spring loaded latched bail which, when released by impact upon the front of the toy vehicle, causes the entire vehicle to flip over, reverses the vehicle motor and exposes a duplicate simulated driver on the opposite side of the vehicle. Nevertheless, there remains a need for a toy vehicle having a force responsive feature such that when the toy vehicle flips over and impacts upon what had been the top of the toy, the toy vehicle of one style is transformed by a movable part into a differently styled toy vehicle.

SUMMARY OF THE INVENTION

The present invention is concerned with providing a toy vehicle in which a movable biased part carried by a chassis cooperates in different positions with opposed faces of the chassis to change the style of the toy vehicle. These and other objects and advantages of the invention are achieved by providing a chassis with first and second faces that are spaced apart and oriented in opposition directions. Each face has at least one surface and no surface on the first face is spaced apart more than a predetermined maximum distance from any surface on the second face. Also included is a piece having a first portion simulating at least part of a first vehicle body and a second portion simulating at least part of a second vehicle body. The piece is carried by the chassis for movement between a first position in which the first portion projects a first greater distance beyond the first face than any projection of the second portion beyond the second face and a second position in which the second portion projects a second greater distance beyond the second face than any projection of the first portion beyond the first face. There is a biasing device that initially biases the piece in the first position until it is overcome by a force urging the piece to move from the first position to the second position and the biasing means then biases the piece to the second position. Preferably the piece is mounted for pivotal movement about a point disposed between the first face and the second face and, as between the front and back end of the chassis, the piece pivots about a point adjacent the back end.

A pair of generally parallel spaced apart axles are carried by the chassis and at least one wheel is mounted on each axle for rotation relative to the chassis so that the wheels support the chassis for movement along the playing surface with one of the first or second faces closer to and oriented toward the playing surface and the other of the first or second faces further from and oriented away from the playing surface. Each wheel has substantially the same predetermined diameter which is greater than any distance between any surfaces of the spaced apart first and second faces along a line generally transverse to the axles. One-half of the predetermined diameter is less than either of the first greater distance or the second greater distance so that the force overcoming the initial bias and urging the piece to move from one of the first or second positions to the other can result from the toy vehicle flipping over and impacting upon the first or second portion that is projecting further beyond the respective first or second face than any projection of the other portion beyond the other face. To bias the piece, there is a leaf spring with its ends constrained to bow the spring so that it snaps into a bow oriented in the opposite direction when it passes over center. Trackway segments provide a banked curve which cause the toy vehicle to flip end over end as the toy vehicle is selectively directed through a vertical arc or cause the toy vehicle to flip over sideways as the toy vehicle goes through the banked curve.

BRIEF DESCRIPTION OF THE DRAWINGS

For a better understanding of the present invention reference may be had to the accompany drawings in which.

DETAILED DESCRIPTION OF THE PREFERRED EMBODIMENT

Figure 1:
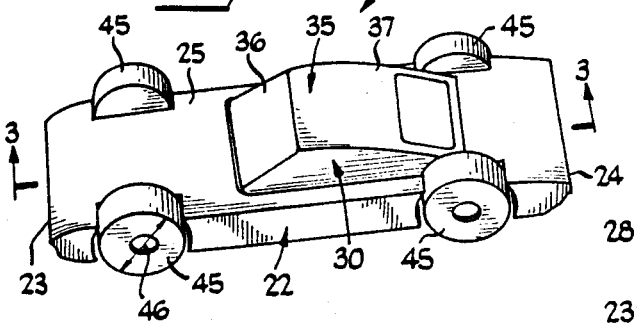
FIG. 1 is a perspective view of a toy vehicle embodying the present invention.
Figure 2:
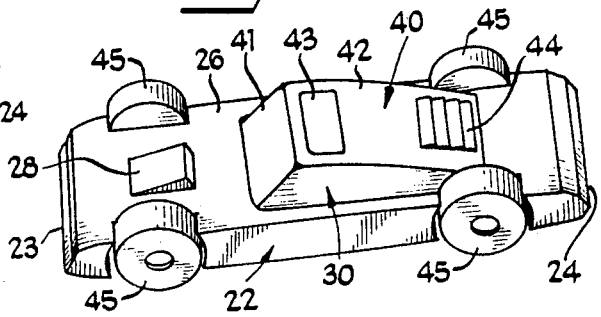
FIG. 2 is another perspective view of the toy vehicle showing the alternate style.
Figure 3:
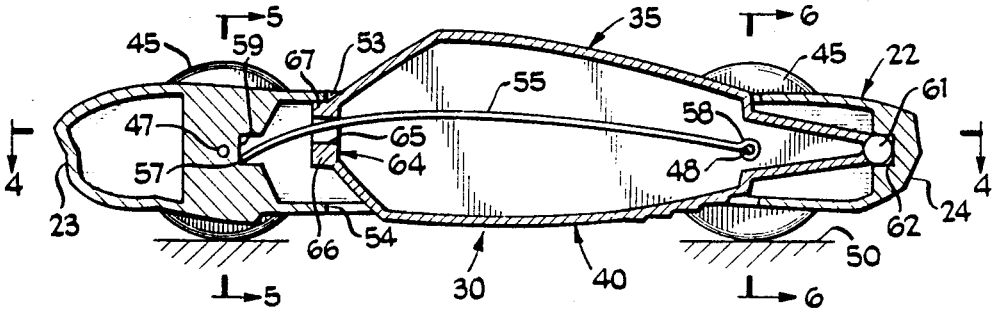
FIG. 3 is an enlarged sectional view taken generally along line 3—3 of FIG. 1.

Referring now to the drawings in which like parts are designated by like reference numerals throughout the several views, there is shown in FIG. 1 a toy vehicle 20 having a chassis 22 with a front end 23 and a back end 24. Chassis 22 has a first face 25, which in FIG. 1 is the upper face, and second face 26, which in FIG. 1 is the unseen lower face that in FIG. 2 appears as the upper face. As is shown in FIGS. 2 and 3, second face 26 includes a simulated blower 28 that extends beyond the surface of hood 29. Each face may have a number of surfaces such as blower 28 and hood 29 as long as no surface of one face is spaced apart more than a predetermined maximum distance from any surface of the other face. A piece 30 is carried by chassis 22 for pivotal movement between a first position shown in FIG. in which a first portion 35 of the piece simulates a windshield 36, roof 37 and rear window 38 of a first vehicle body style. Piece 30, which is shown in its second position in FIG. 2, also has an opposed second portion 40 simulating a windshield 41, roof 42 with sun roof 43 and louvered back window 44 of a second vehicle body style. Portion 35 of piece 30 cooperates with face 25 of chassis 22 to form one style of vehicle while portion 40 of piece 30 cooperates with face 26 of chassis 22 to form a second style of vehicle.

Toy vehicle 20 is provided with four identical wheels 45 each of which has a predetermined diameter 46. Each of one pair of wheels 45 is mounted adjacent an end of a front axle 47 while each of the other two wheels 45 is mounted adjacent an end of a rear axle 48. The axles are spaced from each other by a predetermined span. As is best illustrated in FIG. 3 wheels 45 support toy vehicle 20 for movement along a playing surface 50 with first or upper face 25 further from and oriented away from playing surface 50 while second or lower face 26 is closer to and oriented toward the playing surface. In the position illustrated in FIG. 3, first portion 35 of piece 30 projects through an opening 53 in face 25 a greater distance beyond first face 25 than any projection of second portion 40 beyond second face 26. However, piece 30 is movable from the first position illustrated in FIGS. 1, 3 and 4 to a second position illustrated in FIG. 2 in which second portion 40 projects through an opening 54 in face 26 a greater distance beyond second face 26 than any projection of first portion 35 beyond first face 25. Diameter 46 of each of the wheels 45 is greater than the predetermine maximum distance that any surface of either of opposed faces 25 and 26 is spaced from any surface of the other face measured along any line generally transverse to axles 47 and 48. Accordingly, the predetermined maximum distance is contained within the diameter of the wheels so that no surface of either face 25 or 26 projects beyond the periphery of wheels 45. However, the radius, or one-half of diameter 46, is less than the distance first portion 35 of piece 30 projects beyond face 25 with piece 30 in the position illustrated in FIGS. 1, 3 and 4 and the radius is also less than the distance second portion 40 of piece 30 projects beyond face 26 with piece 30 in the position illustrated in FIG. 2.

Figure 4:
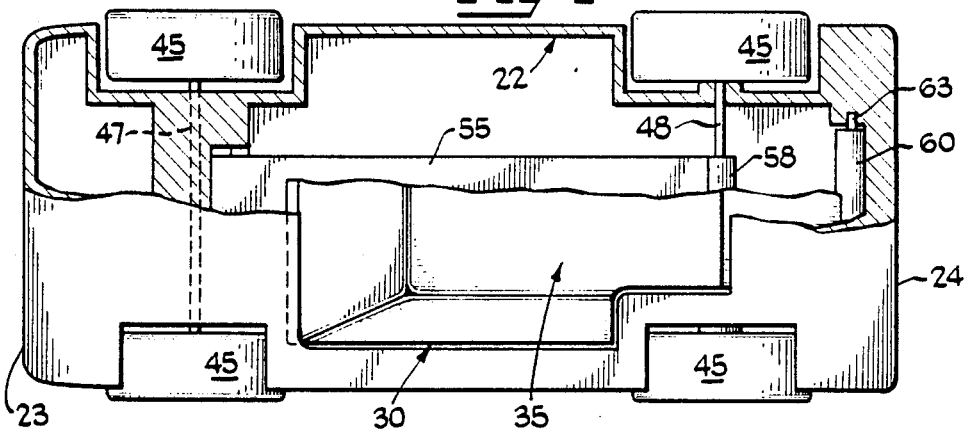
FIG. 4 is an enlarged, top plan view of the vehicle shown in FIG. 1, partially in section along line 4—4 of FIG. 3.
Figure 5:
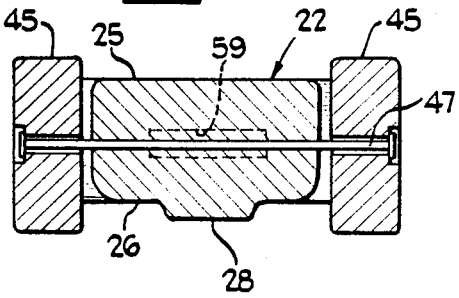
FIG. 5 is a sectional view taken generally along line 5—5 of FIG. 3.
Figure 6:
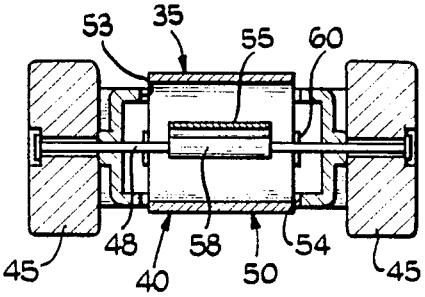
FIG. 6 is a sectional view taken generally along line 6—6 of FIG. 3.

A leaf spring 55 having opposed ends 57 and 58 biases piece 30 to either the first position illustrated in the FIGS. 1, 3 and 4 or the second position illustrated in FIG. 2. Back end 58 of leaf spring 55 is formed in a loop so that it can pivot about rear axle 48 as is best illustrated in FIGS. 3, 4 and 6. Front end 57 of the spring is received in a notch 59 formed in chassis 22 which permits some vertical movement of the spring adjacent end 57. The predetermined dimension between rear axle 48 and notch 59 is less than the predetermined length of leaf spring 55 so that the spring is constrained in its quiescent position in a bowed configuration as illustrated in FIG. 3.

Piece 30 is mounted for pivotal movement about the axis of a cylindrical member 61 that is disposed between face 25 and face 26 of chassis 22 and is generally parallel to front axle 47 and rear axle 48. By placing the pivot axis for piece 30 as far to the rear as possible, the angle of the roofs of portions 35 and 40 may be reduced. Cylindrical member 61, which is part of the back end of piece 30, is received in an inwardly directed recess 62 formed in the rear chassis 22. Member 61 has coaxial trunnions 63 that are journaled in corresponding bores in chassis 22 to facilitate pivotal movement of piece 30. At its forward end 64, piece 35 is provided with a slot 65 through which spring 55 freely passes. Lateral portions 66 and 67 of forward end 64 provide stops when they respectively abut face 26 and 25 of chassis 22.

It will be appreciated that a sufficient force exerted against the bias of spring 55, such as by pushing down upon portion 35 which projects further beyond face 25 than any projection of portion 40 beyond face 26 as illustrated in FIGS. 1, 3 and 4, will overcome the bias of spring 55 and urge piece 30 to pivot about the axis of cylindrical member 61. As piece 30 passes the center position in moving from the first position illustrated in FIGS. 1, 3 and 4 to the second position illustrated in FIG. 2, bowed leaf spring 55 will snap into another, oppositely disposed, bowed configuration in a second quiescent overcenter position and will then bias portion 40 to project further beyond face 26 than any projection of portion 35 beyond face 25 and change the style of toy vehicle 20 from that illustrated in FIG. 1 to that illustrated in FIG. 2. A sufficient force to effect such a change can result from flipping toy vehicle 20 over from a position on a playing surface in which wheels 45 are in contact with the surface and one of first face 25 or second face 26 is closer to and oriented toward the surface to a position in which the wheels are again in contact with the surface but the other face is now closer to and oriented toward the surface. When toy vehicle 20 flips over, the impact upon the first or second portion that is projecting further beyond the respective first or second face than any projection of the other portion beyond the other face will overcome the bias of spring 55 and pivot piece 30 to change the style of toy vehicle 20.

To facilitate flipping over toy vehicle 20 a trackway segment 70 is provided which has an arc support structure 72 with a foot 73 on each side for seating structure 72 on a generally planar portion of a playing surface. Leading into arc support structure 72 is an entry ramp 74 that lies generally in the plane of the portion of the playing surface on which arc support structure 72 is seated. Extending out form arc support structure 72, opposite entry ramp 74, in generally the same plane as entry ramp 74 is an alternate exit ramp 75. Entry ramp 74 and alternate exit ramp 75 conveniently connect with other trackway segments to make an enclosed circuit for toy vehicle 20. Rising from the plane of entry ramp 74 is an upwardly and backwardly curved ramp 76 that forms an arc rising from the plane of entry ramp 74 and extending through about one hundred seventy degrees of curvature with an exit end 77 of curved ramp 76 being spaced above entry ramp 74. Forming a part of curved ramp 76 is a lower curved section 78 that is mounted for pivotal movement adjacent entry ramp 74.

Figure 7:
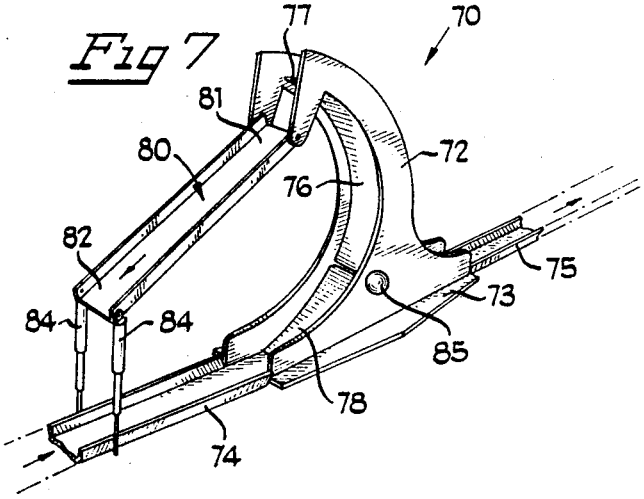
FIG. 7 is a perspective view of a trackway segment.

Disposed below exit 77 of arc support structure 72 is a return trackway segment 80 having an ingress 81 disposed generally directly below exit 77 of arc support structure 72 and egress 82 at the other end. As is well illustrated in FIGS. 7 and 8, return trackway segment 80 is disposed at a downward angle from ingress 81 to egress 82. Trackway segment 80 is generally aligned with entry ramp 74 with egress 82 spaced above entry ramp 74 by support legs 84. Egress 82 must be spaced from entry ramp 74 a sufficient distance to permit the passage of toy vehicle 20 beneath return trackway segment 80 without interference from the return trackway segment. Preferably, ingress 81 is pivotally connected to arc support structure 72 and support legs 84 are pivotally connected to egress 82 so that adjustment of the downward angle of return trackway segment 80 may be made to obtain optimum performance.

Figure 8:
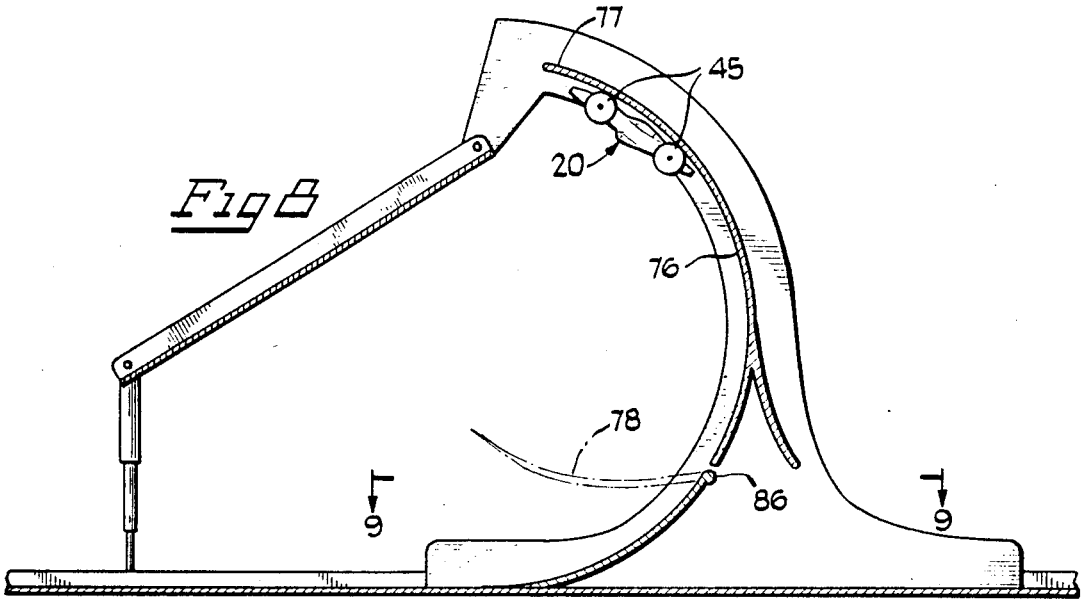
FIG. 8 is an enlarged scale, sectional view taken generally vertically through the center of the trackway segment of FIG. 7.
Figure 9:
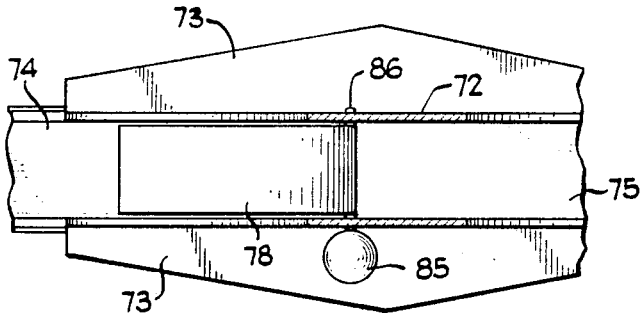
FIG. 9 is sectional view taken generally along line 9—9 of FIG. 8.

Both lower curved section 78 and a knob 85 are secured to a shaft 86 which is journaled for rotation through the sides of arc support structure 72. As is best illustrated in FIG. 8, lower curved section 78 may be pivoted upwardly by grasping and manually twisting knob 85. It will be appreciated that with lower curved section 78 in the upward position illustrated in phantom line in FIG. 2 toy vehicle 20 will past beneath section 78 and pass through arc support structure 72, bypassing curved ramp 76 and going on to alternate exit ramp 75 in the direction of the arrow illustrated in FIG. 7. With lower curved section 78 in the lower position where it is contiguous with the rest of curved ramp 76 and with entry ramp 74, toy vehicle 20 proceeds onto entry ramp 74 in the direction of the arrow indicated in FIG. 7 and then proceeds onto lower curved section 78 and up curved ramp 76 until it reaches exit 77. At the time toy vehicle 20 reaches exit 77 the vehicle will have flipped over from, for example, second face 26 over onto first face 25 and will then drop onto ingress 81 of return trackway segment 80 heading in the opposite direction from its entry on ramp 74. Upon impacting on return trackway segment 80, piece 30 will move from one position to the other resulting in a vehicle of a different style coming back from the flipped over arc trackway segment than when it entered ramp 74. Toy vehicle, in its changed appearance or style, will then proceed in the direction of the arrow indicated on return trackway segment 80 illustrated in FIG. 7, down the trackway segment and drop a short distance onto ramp 74 and proceed in the direction opposite to that indicated by the arrow on ramp 74 to re-enter any other track segments with which ramp 74 is connected.

Figure 10:
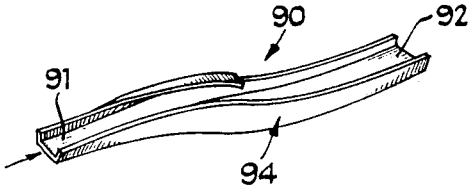
FIG. 10 is a perspective view of another trackway segment.
Figure 11:
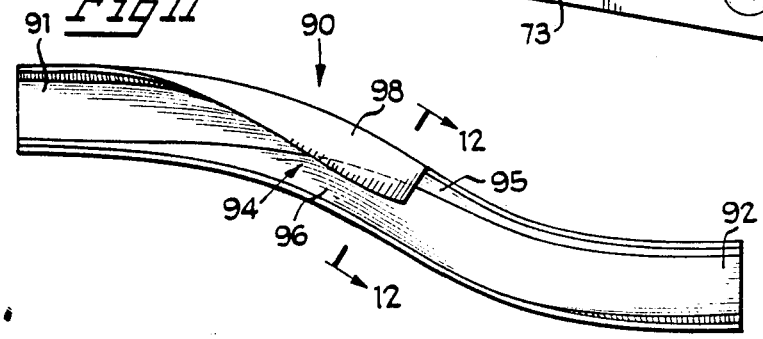
FIG. 11 is an enlarged scale, top plan view of the trackway segment of FIG. 10.
Figure 12:
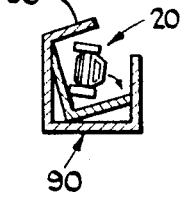
FIG. 12 is a sectional view taken generally along line 12—12 of FIG. 11.

FIGS. 10–12 illustrate another trackway segment 90 that also facilitates flipping over of toy vehicle 20. Trackway segment 90 has an entry 91 and an exit 92 that lie substantially in the same plane. As with trackway segment 70, trackway segment 90 is conveniently connected at entry 91 and exit 92 to other trackway segments to make an enclosed circuit for toy vehicle 20. Between entry 91 and exit 92 is a transition part 94 that is configured so as to cause toy vehicle 20 to flip or roll over laterally as it moves along trackway segment 90 from entry 91 to exit 92. Trackway segment 90, as is perhaps best illustrated in FIGS. and 12, essentially comprises two separate track sections, entry 91 and exit 92, that twist or roll over toward each other where they meet in the approximately centrally disposed transition part 94. Transition part 94 includes a sharply banked curve 95 that deviates from the plane of entry 91 and connects with an oppositely banked curve 96 that leads into the plane of exit 92. Extending inwardly over banked curves 95 and 96 is a lip 98 which ensures that toy vehicle 90 will roll over rather than ride up and out of trackway segment 90 along banked curve 95. When toy vehicle 20 enters trackway segment 90 with wheels 45 on the surface of entry 91, toy vehicle 20 will be oriented with one of first face 25 or second face 26 closer to and oriented toward the playing surface, however, as toy vehicle 20 proceeds through transition part 94 it will roll over in the clockwise direction of the arrow illustrated in FIG. 12 causing that one face to then be oriented further from and away from the surface of exit 92 as toy vehicle 20 exits trackway segment 90.

While particular embodiments of the present invention have been illustrated and described with respect to a toy vehicle, it will be apparent to those skilled in the art that various changes and modifications may be made without departing from the invention. It is intended in the appended claims to cover all such changes and modifications as fall within the true spirit and scope of the present invention.

What is claimed as new and desired to be secured by Letter Patents is:

1. A toy vehicle comprising in combination:

a chassis having a first face and a second face;

the first face and the second face being spaced apart and being oriented in opposite directions;

a piece having a first portion simulating at least part of a first vehicle body and an opposed second portion simulating at least part of a second vehicle body;

the piece being carried by the chassis for movement between a first position in which the first portion projects a first greater distance beyond the first face than any projection of the second portion beyond the second face and a second position in which the second portion projects a second greater distance beyond the second face than any projection of the first portion beyond the first face; and means initially biasing the piece to the first position until overcome by a force urging the piece to move from the first position to the second position and the means subsequently biasing the piece to the second position.

2. The toy vehicle of claim 1 in which:

the piece is mounted for pivotal movement about an axis disposed between the first face and the second face.

3. The toy vehicle of claim 2 in which:

the chassis has a front end and a back end; and the axis about which the piece pivots is adjacent the back end.

4. The toy vehicle of claim 1 including:

a pair of axles carried by the chassis;

the axles being generally parallel to each other and spaced apart from each other a predetermined span;

at least one wheel mounted on each axle for rotation relative to the chassis;

the wheels supporting the chassis for movement along a playing surface with one of the first or second faces closer to and oriented toward the playing surface and the other of the first or second faces further from and oriented away from the playing surface;

each wheel having a predetermined diameter and a periphery that are substantially the same on every wheel;

the predetermined diameter being greater than any distance between any surfaces on the spaced apart first and second faces along a line generally transverse to the axles;

one-half the predetermined diameter being less than either of the first greater distance or the second greater distance so that the force overcoming the initial bias and urging the piece to move from one of the first or second positions to the other can result from the toy vehicle flipping over and impacting upon the first or second portion that is projecting further beyond the first or second face than any projection of the other portion beyond the other face.

5. The toy vehicle of claim 4 in which:

the piece is mounted for pivotal movement about an axis disposed between the first face and the second face.

6. The toy vehicle of claim 4 in which the piece is mounted for pivotal movement about an axis that is generally parallel to the axles.

7. The toy vehicle of claim 6 in which the axis about which the piece pivots is generally parallel to the axles and outboard of one of axles rather than between the spaced apart axles.

8. The toy vehicle of claim 7 in which:

the chassis has a front end and a back end;

the axis about which the piece pivots is adjacent the back end.

9. The toy vehicle of claim 4 in which:

the biasing means is a leaf spring;

the leaf spring has opposed ends and is of a predetermined length between the opposed ends;

the leaf spring is mounted such that the opposed ends are constrained within a predetermine dimension that is less than the predetermined length of the leaf spring resulting in the leaf spring having a bowed configuration in a quiescent position; and one of the opposed ends of the leaf spring is secured to an axle of one of the wheels.

10. The toy vehicle of claim 9 in which:

the piece has opposed ends; and at least one end of the piece has a slot through which the leaf spring passes.

11. The toy vehicle of claim 4 further comprising means causing the chassis to flip over as the chassis moves on the wheels along a playing surface resulting in the first or second face that had been further from and oriented away from the playing surface before the chassis flipped over, impacting upon the playing surface and urging the piece to move from one of the first or second positions to the other.

12. The toy vehicle of claim 11 in which the flip over means comprises a trackway segment having an entry lying in one plane and an arc rising from the one plane and extending through more than ninety degrees of curvature so that the chassis moving along a track surface provided by the trackway segment from the entry through the arc is so disposed as to cause the chassis to flip over by force of gravity.

13. The toy vehicle of claim 12 in which:

the arc has an exit disposed above the one plane;

spaced below the exit of the arc but above the one plane is a return trackway segment;

the return trackway segment having an ingress and an egress;

the ingress being disposed generally directly below the exit of the arc;

the return trackway segment angling downwardly from the ingress to the egress; and the egress being disposed above the one plane.

14. The toy vehicle of claim 13 in which the flip over means includes a section of the arc mounted for pivotal movement adjacent the entry for movement between an arc completing position and a position in which the section is pivoted away from the entry and the arc to permit the chassis to pass through and bypass the arc.

15. The toy vehicle of claim 11 in which the flip over means comprises:

a trackway segment having an entry, an exit and a transition part connecting the entry and the exit;

the transition part being configured so as to cause the chassis to flip over as it moves from the entry to the exit.

16. The toy vehicle of claim 15 in which:

the entry and the exit are offset with respect to each other;

the entry lies in one plane; and the transition part has a banked curve that deviates from the entry plane and connects with the exit such that the banked curve results in the chassis moving along the trackway segment from the entry toward the exit being so disposed as to flip over by force of gravity.

17. The toy vehicle of claim 16 including a lip extending inwardly over the banked curve.

18. The toy vehicle of claim 1 in which the biasing means is a leaf spring.

19. The toy vehicle of claim 18 in which:

the leaf spring has opposed ends and is of a predetermined length between the opposed ends;

the leaf spring is mounted such that the opposed ends are constrained within a predetermined dimension that is less than the predetermined length of the leaf spring resulting in the leaf spring having a bowed configuration in a quiescent position.

20. The toy vehicle of claim 18 in which:

the piece has opposed ends; and at least one end of the piece has a slot through which the leaf spring passes.

* * * * *